US007513381B2

(12) United States Patent
Heng et al.

(10) Patent No.: US 7,513,381 B2
(45) Date of Patent: Apr. 7, 2009

(54) CLOSURES

(75) Inventors: John Montgomery Heng, Palmerston North (NZ); Evan George Griffiths, Palmerston North (NZ); Norman Sands, Palmerston North (NZ)

(73) Assignee: Click Clack Limited, Palmerston North (NZ)

( * ) Notice: Subject to any disclaimer, the term of this patent is extended or adjusted under 35 U.S.C. 154(b) by 430 days.

(21) Appl. No.: 10/486,795

(22) PCT Filed: Sep. 10, 2002

(86) PCT No.: PCT/NZ02/00173

§ 371 (c)(1),
(2), (4) Date: Feb. 13, 2004

(87) PCT Pub. No.: WO03/024824

PCT Pub. Date: Mar. 27, 2003

(65) Prior Publication Data

US 2004/0245251 A1 Dec. 9, 2004

(30) Foreign Application Priority Data

Sep. 14, 2001 (NZ) ..... 514173

(51) Int. Cl.
*B65D 53/00* (2006.01)
*B65D 43/04* (2006.01)

(52) U.S. Cl. ..... 220/238; 220/801; 220/806; 215/359

(58) Field of Classification Search ..... 220/233, 220/234, 238, 262, 801, 805, 806; 215/294, 215/358, 359, 355; 138/90
See application file for complete search history.

(56) References Cited

U.S. PATENT DOCUMENTS

| | | | | | |
|---|---|---|---|---|---|
| 1,939,569 | A | * | 12/1933 | Pfister | 215/359 |
| 2,822,108 | A | * | 2/1958 | Moeller | 220/238 |
| 2,967,637 | A | * | 1/1961 | De Pew | 220/238 |
| 3,004,680 | A | * | 10/1961 | Moeller | 215/359 |
| 4,188,675 | A | * | 2/1980 | Ast | 4/295 |
| 4,303,121 | A | * | 12/1981 | Pangborn | 165/104.12 |
| 4,387,825 | A | * | 6/1983 | Parent | 220/234 |
| 4,390,109 | A | * | 6/1983 | Schulein et al. | 220/234 |
| 4,537,325 | A | * | 8/1985 | Zieff | 220/234 |

(Continued)

FOREIGN PATENT DOCUMENTS

GB 2 299 575 10/1996

*Primary Examiner*—Anthony D Stashick
*Assistant Examiner*—James N Smalley
(74) *Attorney, Agent, or Firm*—Young & Thompson

(57) ABSTRACT

A closure for the open mouth of an airtight container. The closure has a resiliently flexible diaphragm which has a peripheral edge (37) which can sealing engage against an inside wall surface of the open mouth. The diaphragm (13) is engaged with the second cover section (12) of a cover. A pair of toggles (24) are pivotally mounted on axles (22) of second cover section (12). The levers (30) of the toggles (24) extend through an opening (44) in the first or outer cover section (11) when the first and second cover sections (11,12) are snap-locked together. By moving the levers (30) toward one another the respective feet (27) of the toggle (24) engage with area (35) of the diaphragm (13) to deform the diaphragm and thereby break a sealing effect between the peripheral edge of the diaphragm and the inside wall surface of the open mouth.

13 Claims, 6 Drawing Sheets

U.S. PATENT DOCUMENTS 4,747,511 A 5/1988 Dutt et al.
4,942,970 A * 7/1990 Jay ..... 215/358
5,660,302 A 8/1997 Trout
5,845,800 A * 12/1998 Shaw et al. ..... 220/210
6,170,690 B1 * 1/2001 Hosoi ..... 220/238
6,318,870 B1 * 11/2001 Spooner et al. ..... 359/872
6,513,549 B2 * 2/2003 Chen ..... 138/89

* cited by examiner

CLOSURES

BACKGROUND OF THE INVENTION

The present invention relates to an improved closure and more particularly a closure for use with an airtight container.

It, is known from our New Zealand patent specification 211227 to provide an airtight container which includes a body having an open mouth into which a closure can sealingly fit. The mouth includes a peripheral wall surface against which a diaphragm of the closure can engage to sealingly close the mouth. A toggle arrangement is used to deform the diaphragm such that the sealing contact is broken, thereby permitting the closure to be removed and reinserted.

The closure of the type disclosed in our NZ 211227 has been very successful. However, it has been found that when the diaphragm is removed, as it often is by the user, it is possible to disassemble the toggle arrangement. This can cause damage to the toggle arrangement and/or present difficulty to the user to reassemble the toggle arrangement.

We have also found that it is desirable to be able to change the visual appearance of the closure so as to keep abreast of fashion changes and/or provide closures of different appearance so that container/closure combinations can be distinguished one from the other. For example, it is desirable to be able to provide closures of different appearances for different resellers of the product.

Furthermore, from a manufacturing point of view, there is always a need to strive for increased production rates with hopefully decreased production costs.

SUMMARY OF THE INVENTION

An object of the present invention is to provide a closure for engagement with the mouth of a container, the closure being of an improved construction which at least goes some way to achieving one or more of the above desiderata.

Broadly in one aspect of the invention there is provided a closure for the open mouth of a container, the closure including a resiliently flexible diaphragm sealable against an inside wall surface of the open mouth of the container, a cover with which the diaphragm is mounted and deformation means whereby the diaphragm can be deformed so as to reduce an overall dimension of the diaphragm to break a sealing effect between a peripheral edge of the diaphragm and the inside wall surface, the cover being formed from first and second cover sections coupled together and retaining therebetween at least part of the deformation means.

BRIEF DESCRIPTION OF THE DRAWINGS

In the following more detailed description of the invention reference will be made to the accompanying drawings in which:—

DESCRIPTION OF A PREFERRED EMBODIMENT OF THE INVENTION

Figure 1:
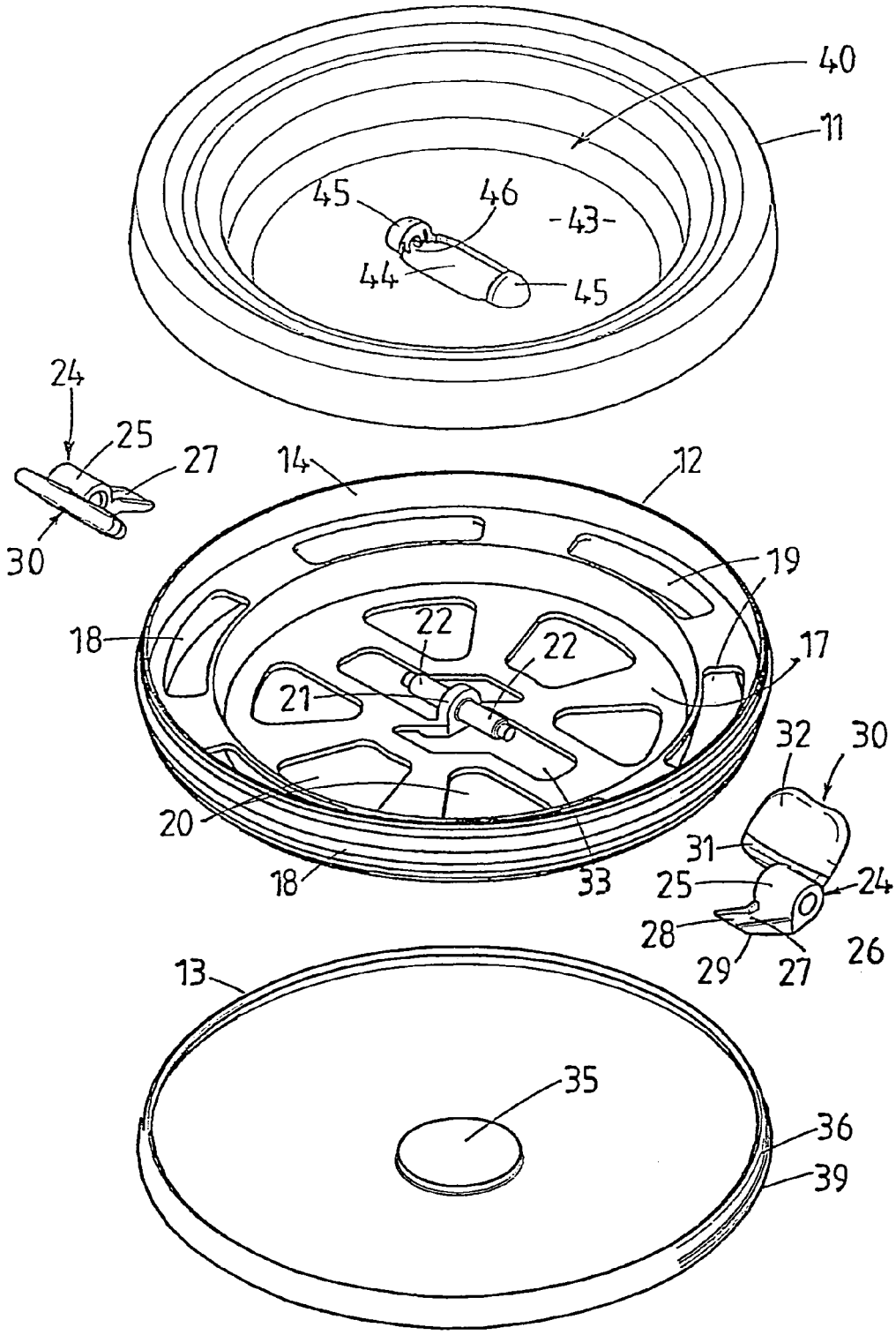
FIG. 1 is an exploded view of the closure illustrating the five components thereof.

Referring to FIG. 1, the five components comprising the closure are illustrated. These components are an upper lid 11, a lower lid 12, a diaphragm 13 and a pair of toggles 30. As will be hereinafter described, the toggles 24 are located on respective axles 21 of the lower lid 12. The toggles are operatively retained in place on axles 21 when the upper lid 11 and lower lid 12 are snap-locked together. The diaphragm 13 is snap-attached to the lower lid 12.

The lower lid 12 includes a peripheral wall 14 which is connected by step 15 to a dished portion 16. Located inward of the peripheral wall 14 and extending downwardly from step is a lower peripheral wall 18.

Cutouts 19 are formed in step 15. Cutouts 20 are also formed in the floor 17 of the dish portion 16. These cutouts 19 and 20 reduce the amount of plastic required for moulding of the lower lid 12. In addition, they provide an overall strengthening function. Furthermore, the cutouts 19 and 20 provide for drainage, when diaphragm 13 is removed, of any moisture buildup between the lower lid 12 and upper lid 11.

Figure 2:
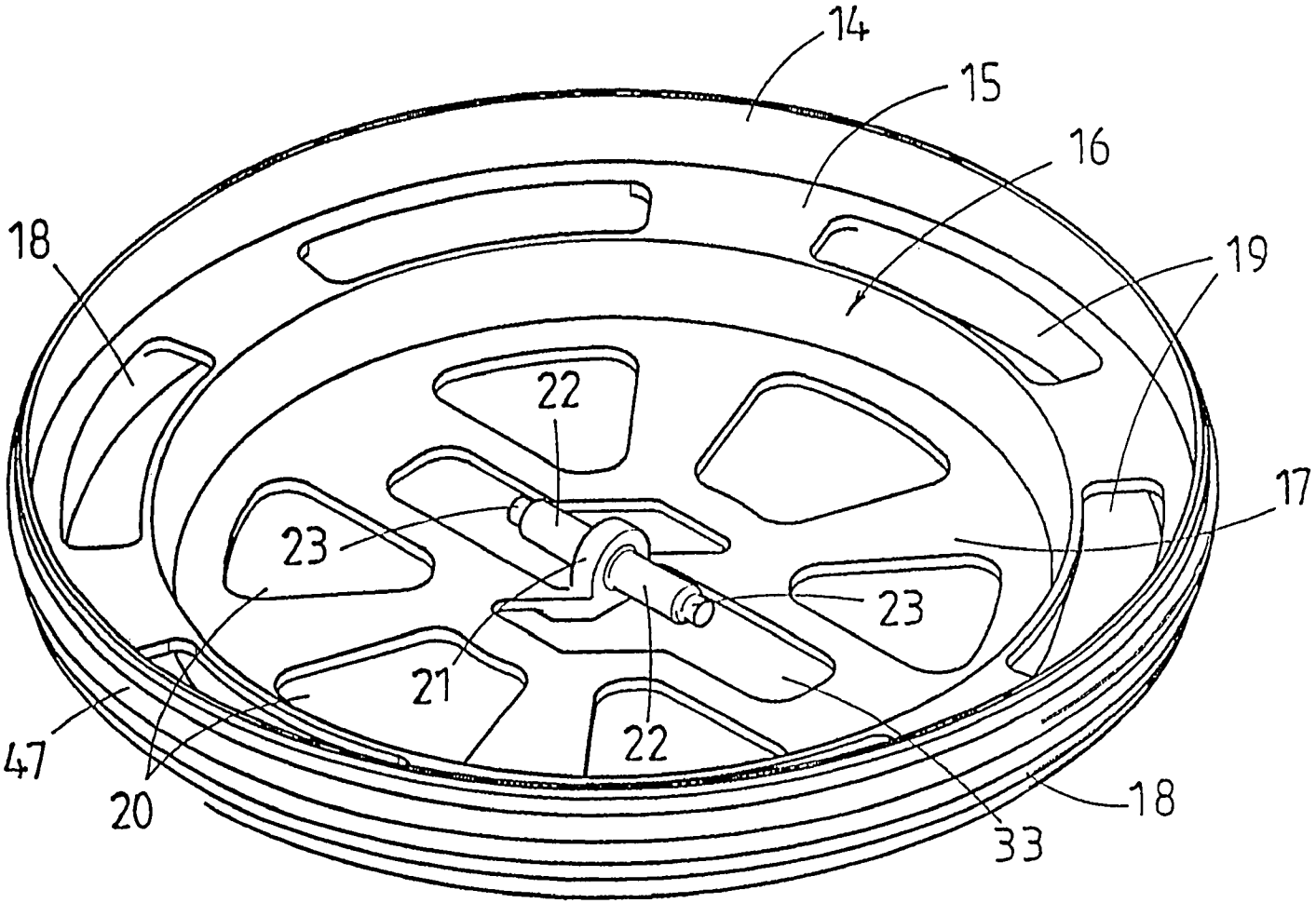
FIG. 2 is a perspective view of the lower lid portion of the closure.

In the centre of the dished portion 16 there is provided an axle support 21. This projects above the upper surface (as viewed for example in FIGS. 1-3) of the floor 17. Projecting from the axle support 21 in opposed radial directions are axles 22. At the distal end of each axle 22 is a stub-axle 23 which is of reduced diameter relative to the main axle 22.

Each toggle 24 includes a boss 25 which has therethrough a bore 26. The internal diameter of the bore 26 is just slightly greater than the external diameter of the main axle 22. Projecting outwardly from the boss 25 is a toggle foot 27 which has a toe portion 28 and a cam face 29.

Projecting to the other side of the boss 25 is an operating lever 31. In the preferred form of the invention the toggle 24 is moulded from a hard plastic material. A plastic material which feels softer to the touch is over-moulded on operating lever 31 to form a finger grippable portion 32.

In floor 17 of lower lid 12 are formed a pair of cutouts 33 which are located below the axles 22/23. The cutouts 33 each extend beyond the distal end of the respective axle 23. Cutouts 33 provide a clearance to enable the toggle 24 to be mounted on the axle 22 by inserting the axle 22 into bore 26. This is achieved by positioning the toggle 24 and then sliding the boss 25 onto the axle 22.

When the toggle 24 is placed in position (see FIG. 3) the toggle foot 27 locates within a suitably shaped cutout 34 which merges into cutout 33.

Figure 3:
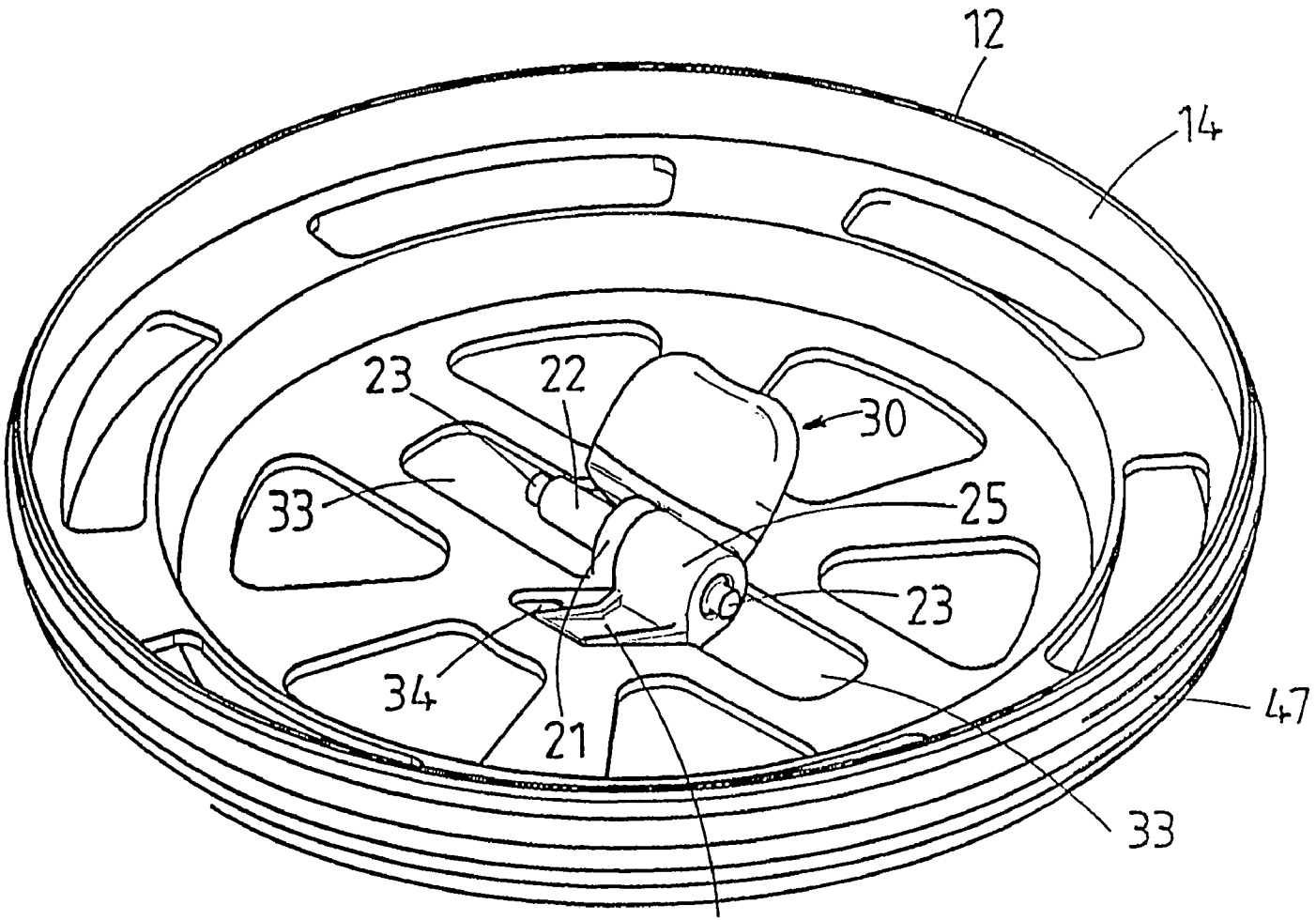
FIG. 3 is a view similar to FIG. 2 but showing one of a pair of toggles in place.
Figure 6:
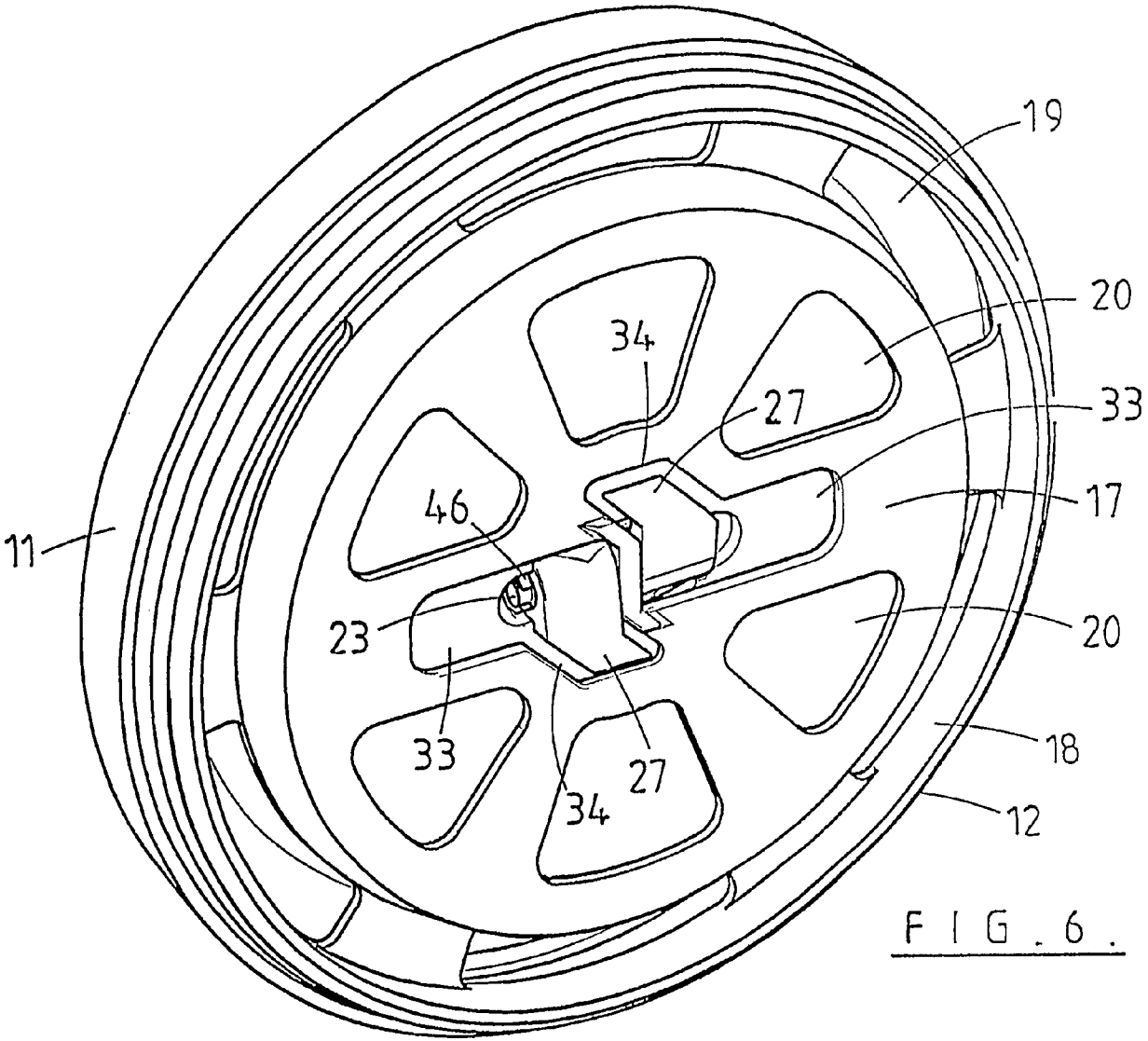
FIG. 6 is a perspective underside view of the assembled closure but with the diaphragm removed.

In FIG. 3 only one toggle 24 is shown in position. It will be appreciated that when the other toggle 24 is located in position the operating levers 31 are oppositely disposed. Also, the toggle feet 27 extend in opposite directions as can be seen in FIG. 6.

The diaphragm 13 incorporates a central boss 35 which in the assembled closure is contactable by the toggle feet 27 as will hereinafter be described.

Extending peripherally about the diaphragm 13 is a wall 36. The upper or distal end of the wall 36 includes an inwardly projecting rim 37. When the diaphragm 13 is assembled with the lower lid 12 this rim 37 snap-attaches in a groove 38 formed in the lower peripheral wall 18 of the lower lid 12.

A sealing edge 39 is formed at the peripheral extremity of the diaphragm 13. This sealing surface 39 sealingly engages with a surface of the mouth of the container in which the closure is sealingly located in use.

The upper lid 11 includes a dish portion 40. The dish portion 40 is connected to a peripheral downwardly depending skirt 41 by a stepped portion 42. This stepped portion 42 forms a shelf able to receive the lower end of a similar container so that containers with closures according to the present invention can be stacked one upon the other.

In the floor 43 of dish portion 40 there is formed an aperture 44. The aperture 44 is elongate in form and at each end thereof there is formed a housing 45 which has a downwardly depending substantially U-shaped clip 46. This clip 46 is designed to snap-lock engage with the stub-axle 23 when the upper lid 11 and lower lid 12 are combined. The arrangement is such that stub-axle 23 is held within clip 46.

Figure 4:
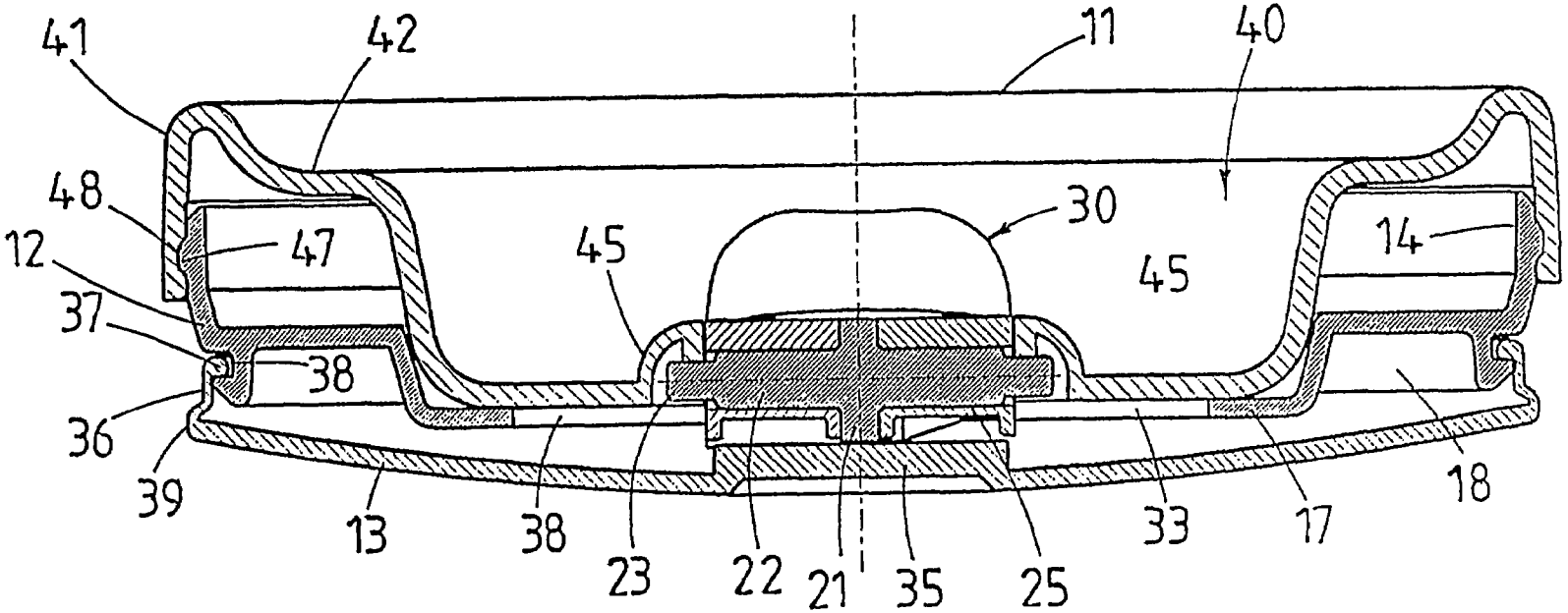
FIG. 4 is a cross-sectional view of the assembled closure, the cross-section being taken on a diameter through the centre of the axle on which the toggles are mounted.

The outer peripheral surface of the peripheral wall 14 of the lower lid 12 is profiled so that it can snap-lock fit with a similarly profiled inner face surface of the skirt 41 of upper lid 11. As can be seen in FIG. 4, the peripheral wall 14 essentially has a rib 47 which interengages with a peripherally extending groove 48 in the inside surface of skirt 41.

With the toggles 24 located on the axles 22 the lower lid 12 can be assembled with the upper lid 11. To achieve this the toggle operating levers 32 are pulled toward one another so as to be able to fit through aperture 44 in floor 43 of the dish portion 40. The upper lid 11 and lower lid 12 can then be brought together so that dish portion 40 locates within dish portion 16. When these mate together, as shown in FIG. 4, the peripheral wall 14 of the lower lid 12 snap-fits within the skirt 41 of the upper lid 11. Also, the stub-axles 23 snap-lock into the respective clips 46 of the housing 45 at the opposite ends of elongate slot 44.

The lower lid 12 is thus not only interengaged with the upper lid 11 at the interjoin of the peripheral wall 14 and skirt 41 but is also positively locked centrally to the upper lid 11 by virtue by the stub-axles 23 locking into clips 46. This interengagement of the clip 46 and stub-axles 23 not only forms a mechanical join between the upper lid 11 and lower lid 12 but also ensures that the toggles 24 are correctly retained on the axles 22.

Figure 5:
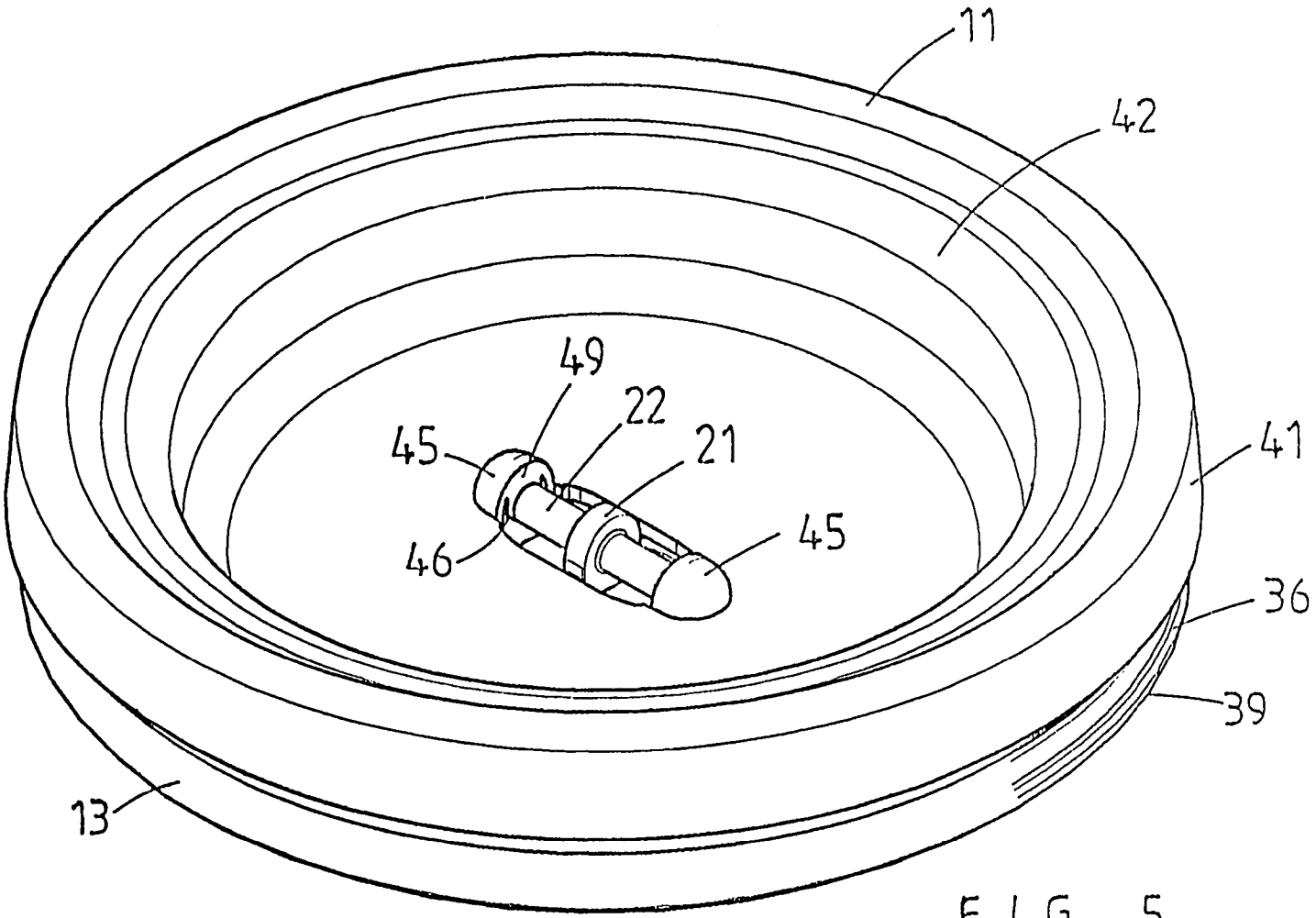
FIG. 5 is a perspective view of the assembled closure but with the toggles not shown in place.

As can been in FIG. 4, the dimensions are such that the boss 25 of each toggle 24 locates snugly between the axle support 21 and a face surface 49 (see FIG. 5) of the housings 45. Furthermore, the dimensioning of the boss 25 and the elongate slot 44 is such that the edge of the slot 44 closely locates adjacent the surface of the boss 25.

Due to the snap-lock coupling of the upper lid 11 with the lower lid 12 it is difficult to visually see that the lid is formed from two separate components. Thus, the lid portion of the closure has good structural integrity. Furthermore, it is believed that, in use, an end user will not try and disassemble the toggles 24 from the lid construction 11/12.

With the lid assembled the diaphragm 13 can then be located in place by distorting the diaphragm wall 36 so that the rim 37 can engage in groove 38. The resultant assembly locates the diaphragm boss 35 adjacent the cam face 29 and toe 28 of each toggle 24. Thus, a user can, by gripping the operating levers 30 and squeezing them toward each other, cause the toggle feet 27 to apply a downward force on the diaphragm boss 35.

The force applied by the toggles 24 to the diaphragm boss 35 causes an effective reduction in the diameter of the peripheral edge of diaphragm 13 thereby pulling sealing edge 39 away from the facing surface of the mouth of the container in which the closure is located. The closure can then be lifted away from the container.

The same procedure is adopted when placing the closure back in the mouth of the container. Thus, once the closure is located in place the user releases pressure on the toggles. Because of the resiliency built into the diaphragm it restores itself to its normal configuration. This results in the sealing edge 39 engaging in the required sealing manner with the peripheral surface of the mouth of the container. This restoring of the diaphragm 13 to its normal state causes the toggles 24 to revert to their "rest" position.

The present invention therefore provides a closure which is formed of first and second lid sections coupled together and retaining in place therebetween the deformation means in the form of a pair of toggles. These toggles are located opposite one another and can function about a radial axis to achieve a vertical force/movement of the diaphragm. This vertical movement is a preferred form of the invention exceeds about 7 mm and thus can deform the diaphragm so that the peripheral sealing edge thereof can be reduced so as to break a seal between the peripheral edge and the sealing wall surface of the open mouth of a container.

Not only does the two-part construction of the lid provide a means of readily locking and retaining the toggles in place but it also permits a manufacturer to have a standard sub-base (the lower lid 12) and diaphragm 13 and thereby only needs to change the cover portion i.e. the upper lid 11 to change the appearance of the closure. Thus, different aesthetic designs can be readily achieved without major retooling on the part of the manufacturer.

It is also believed that the present invention can lead to increased production rates and hopefully a reduction in production costs. The closure is easy and foolproof to assemble and when assembled retains the toggle mechanism so that it will not fall out and will not be readily accessible by the end user even when the diaphragm is removed.

It is also anticipated that the upper and lower lids can be manufactured in a single tool. So that upon removal of the components from the tool the lid can be immediately assembled with previously moulded toggles. This will cut down on handling within the manufacturing plant and also enables quality control to take place at the point of primary manufacture. The assembled lid can then be fitted with a separately manufactured diaphragm to complete the assembly of the closure.

The invention claimed is:

1. A closure for the open mouth of a container, the closure including:

a resiliently flexible diaphragm including a sealing edge with a perimeter defining a periphery of the diaphragm, the sealing edge of the diaphragm being sealable against an inside wall surface of the open mouth of the container;

a cover with which the diaphragm is mounted; and a deformation mechanism, whereby the diaphragm can be deformed so as to reduce a length of the perimeter of the sealing edge of the diaphragm to break a sealing effect between the sealing edge of the diaphragm and the inside wall surface, wherein the cover comprises first and second cover sections coupled together and retaining therebetween at least part of the deformation mechanism, wherein the first and second cover sections are coupled together by first and second separate mechanical connections, and wherein the first mechanical connection is formed by fitting together a peripheral skirt of the first cover section and a peripheral wall of the second cover section in an overlapping arrangement.

2. A closure as claimed in claim 1 wherein the second mechanical connection is formed by the first cover section interlocking with a part of the deformation mechanism mounted by the second cover section.

3. A closure as claimed in claim 1 wherein the first cover section includes a dished portion, which engages within a dished portion of the second cover section.

4. A closure as claimed in claim 3 wherein the dished portion includes drainage openings for drainage of any accumulation of moisture between the first and second cover sections.

5. A closure as claimed in claim 2 wherein the diaphragm is mounted to the cover by the second cover section.

6. A closure as claimed in claim 5 wherein the second cover section includes a peripheral groove into which is fitted a peripheral projection of the diaphragm.

7. A closure for the open mouth of a container, the closure including:

a resiliently flexible diaphragm including a sealing edge with a perimeter defining a periphery of the diaphragm, the sealing edge of the diaphragm being sealable against an inside wall surface of the open mouth of the container;

a cover with which the diaphragm is mounted; and a deformation mechanism, whereby the diaphragm can be deformed so as to reduce a length of the perimeter of the sealing edge to break a sealing effect between the sealing edge of the diaphragm and the inside wall surface, wherein the cover comprises first and second cover sections coupled together and retaining therebetween at least part of the deformation mechanism, wherein the deformation mechanism includes a pair of toggles pivotally mounted with the cover, each toggle including an engagement portion engageable with a contact area of the diaphragm, and wherein the second cover section includes a pair of axles, each axle engaging with a sleeve of a toggle, and wherein each axle has a stub axle which is held within a clip of the first cover section.

8. A closure as claimed in claim 7 wherein the deformation mechanism includes a pair of toggles pivotally mounted with the second cover section, the pivoted mounting incorporating at least one stub-axle, which is connected to a mounting of the first cover section to form a second mechanical connection.

9. A closure as claimed in claim 7 wherein each toggle includes a lever, which projects through the first cover section, said lever being overmoulded with a soft feel plastic material.

10. A closure as claimed in claim 7 wherein each toggle includes a lever, which projects through an opening in the first cover section, said levers being oppositely disposed.

11. A closure as claimed in claim 10 wherein each lever projects from a respective sleeve, each sleeve being pivotally mounted on an axle carried by the second cover section, and wherein the engagement portion is formed by a foot, each foot being coupled to a respective sleeve, and each foot projecting from a side of the respective sleeve that is substantially opposite to the side from which the lever projects.

12. A closure as claimed in claim 11 wherein each foot extends on an incline relative to a central pivot axis of the respective sleeve.

13. A closure for the open mouth of a container, the closure including:

a resiliently flexible diaphragm including a sealing edge with a perimeter defining a periphery of the diaphragm, the sealing edge of the diaphragm being sealable against an inside wall surface of the open mouth of the container;

a cover with which the diaphragm is mounted; and a deformation mechanism, whereby the diaphragm can be deformed so as to reduce a length of the perimeter of the sealing edge to break a sealing effect between the sealing edge of the diaphragm and the inside wall surface, wherein the cover comprises first and second cover sections coupled together and retaining therebetween at least part of the deformation mechanism, wherein the deformation mechanism includes a pair of toggles pivotally mounted with the cover, each toggle including an engagement portion engageable with a contact area of the diaphragm, wherein each toggle includes a lever, which projects through an opening in the first cover section, said levers being oppositely disposed, wherein each lever projects from a respective sleeve, each sleeve being pivotally mounted on an axle carried by the second cover section, and wherein the engagement portion is formed by a foot, each foot being coupled to a respective sleeve, and each foot projecting from a side of the respective sleeve that is substantially opposite to the side from which the lever projects, wherein each foot extends on an incline relative to a central pivot axis of the respective sleeve, and wherein the foot has a distal end, which engages with an area of the diaphragm which is of increased thickness.

* * * * *